US006647570B1

(12) United States Patent
Ong

(10) Patent No.: US 6,647,570 B1
(45) Date of Patent: Nov. 18, 2003

(54) SELF-STORING BEDDING ARTICLE

(76) Inventor: Bon S. Ong, P.O. Box 4247, Torrance, CA (US) 90510

( * ) Notice: Subject to any disclaimer, the term of this patent is extended or adjusted under 35 U.S.C. 154(b) by 0 days.

(21) Appl. No.: 10/150,416

(22) Filed: May 20, 2002

(51) Int. Cl.[7] ..... A47G 9/06
(52) U.S. Cl. ..... 5/485; 5/484; 5/502; 5/417
(58) Field of Search ..... 5/482, 484, 485, 5/490, 502, 417, 419, 420

(56) References Cited

U.S. PATENT DOCUMENTS 1,871,003 A * 8/1932 Longletz et al. ..... 5/420 X
2,038,335 A * 4/1936 Aronow ..... 5/485
2,045,784 A * 6/1936 Leve ..... 5/419
2,357,789 A * 9/1944 Levy ..... 5/484 X
2,870,464 A * 1/1959 Lalick ..... 5/502 X
4,101,994 A * 7/1978 Hoyt ..... 5/419
4,734,948 A * 4/1988 Danova ..... 5/502
5,088,139 A * 2/1992 Bloom ..... 5/420
5,454,125 A * 10/1995 Ratkowski ..... 5/417
5,457,829 A * 10/1995 Elliott ..... 5/420
5,463,783 A * 11/1995 Pope ..... 5/417
5,533,653 A * 7/1996 Kaufman ..... 224/577
5,587,219 A * 12/1996 Schofield ..... 5/419 X
5,629,071 A * 5/1997 Feldman ..... 5/419 X
5,758,373 A * 6/1998 Bloetjes ..... 5/417
5,843,556 A * 12/1998 Levas ..... 5/417 X
5,850,643 A * 12/1998 Brumfield ..... 5/419
5,920,931 A * 7/1999 Zuehlke et al. ..... 5/485 X
5,987,667 A * 11/1999 Haverly et al. ..... 5/485
6,023,797 A * 2/2000 Brumfield ..... 5/419
6,192,536 B1 * 2/2001 Connors ..... 5/417
6,393,638 B1 * 5/2002 MacColl ..... 5/419

* cited by examiner

*Primary Examiner*—Robert G. Santos
(74) *Attorney, Agent, or Firm*—Charles H. Thomas

(57) ABSTRACT

A self-storing article of bedding is constructed with a pair of pocket panels that overlie a limited surface area on the top of a cover, thereby defining a pocket region of the cover and a larger peripheral region extending beyond the pocket region. The pocket panels reside atop overlapping portions of the pocket region of the cover and have boundary edges that are sewn to the cover, thereby defining the perimeter of the pocket region. Linear, free, overlapping edges of the pocket panels extend between their respective boundary edges. Mutually engageable, releaseable fasteners are provided on the pocket panels in the area of mutual overlap. The pocket panels are reversible in orientation. When the pocket panels are oriented so that their reverse surfaces face each other, the peripheral region of the cover may the folded and stuffed in between the reverse surfaces of the pocket panels and the pocket region of the cover. Alternatively the orientation of the pocket panels may be reversed, thereby allowing the peripheral region of the cover to be spread out to extend laterally from the pocket panels, thereby leaving the reverse surfaces of the pocket panels facing outwardly and their obverse surfaces facing the top surface of the cover over the pocket region thereof.

20 Claims, 14 Drawing Sheets

SELF-STORING BEDDING ARTICLE

BACKGROUND OF THE INVENTION

1. Field of the Invention

The present intervention relates to a self-storing article of bedding.

2. Description of the Prior Art

At present conventional articles of bedding such as blankets, sheets, comforters, sleeping bags, and other covers are formed of one or more layers of flexible fabric which may be spread out in a generally flat disposition to cover a wide, expansive area. Such covers may be folded for more compact storage. However, conventional covers lack any particular storage case that allows them to be conveniently transported or otherwise handled so that the cover does not readily unfold. Some articles of bedding, particularly children's bedding are frequently transported from one place to another. Parents frequently take children with them to visit friends and relatives. Since such visits frequently last past a child's bedtime, the child's articles of bedding are often taken along so that the child can temporarily sleep at the location being visited. Also, older children frequently love to engage in sleepovers with their friends. However, without some means of holding an article of bedding folded together, the bedding articles often unfold and become difficult to deal with during transport.

One expedient is to simply fold the article of bedding and stuff it into a paper or plastic bag. However, such a means for transporting an article of bedding is unsightly. Also, a suitable bag must be located each time the article of bedding is to be transported.

Some articles of bedding, such as sleeping bags, often come with their own separate storage and transportation sack. However, when the bedding article is unfolded, the sack becomes separated from it and is sometimes difficult to locate.

SUMMARY OF THE INVENTION

The present intervention is a unique article of bedding that is formed in such a way that it can be used as a conventional cover, but which is also equipped with its own self-contained storage envelope or pouch. The article of bedding can be spread out in a sheet-like form so as to cover a rather large area. The bedding article may take the form of a comforter, blanket, sleeping bag, sheet, beach towel, afghan, or bedspread. Actually, the invention is not limited to an article of bedding, since the same structural arrangement can be applied to items such as tablecloths, curtains, picnic blankets, play pen pads, and to other fabric or flexible plastic articles as well.

In any application of use, the invention involves a cover that may be spread out over a relatively large area, but which may be folded into a relatively small volume. The invention also includes a pair of flexible fabric pouch panels having opposing obverse and reverse surfaces. The pouch panels are disposed atop a relatively small area or region of the cover and are secured to the cover throughout about their peripheral boundary edges, as by sewing the panels to the cover. The peripheral, boundary edges of the overlapping pouch panels thereby define the area of the pocket region of the cover. The free edges of the panels that extend between their respective boundary edges overlap each other. The pouch panels are preferably provided with mutually engageable releaseable fasteners where they overlap.

For identification purposes one of these panels may be considered to be a first panel and the other a second panel. The first panel covers slightly over one-half of the pocket region of the cover. In the construction of the bedding article the entire obverse surface area of the first panel resides in direct face-to-face relationship with the top surface of the portion of the pocket region of the cover over which it extends, when the panels are in a first orientation. The other panel may be considered to be the second panel and also covers slightly more than one-half of the pocket region of the cover. The second panel extends over the remaining area of the pocket region of the cover that lies beyond the first panel, and also over an overlapping portion of the pocket region that is also covered by the first panel which resides therebeneath when the panels are in the first condition of orientation.

The first and second pouch panels are preferably provided with mutually engageable releaseable fasteners, such as the flexible, resilient fabric hook and loop fasteners sold under the registered trademark Velcro®. When the releaseable fasteners are disengaged from each other, the orientations of the panels may be reversed. That is, in a first orientation the obverse surfaces of the first and second panels both face the top surface area of the pocket region of the cover and form a pocket therebetween. Small articles may be stored in this pocket if desired, for example, cloth or soft paper articles, such as tissues, bibs, wipes, and other soft articles may be stored in the pocket when the panels are in the first orientation. However, typically heavier or hard articles would not be stored in the pocket, since the article of bedding would then become uncomfortable to lie upon or lie beneath. When the panels are in the first orientation described, the article of bedding is typically deployed for use for its intended purpose as a cover, sheet, sleeping, bag or other article of bedding.

On the other hand, the releaseable fasteners holding the overlapping portions of the pouch panels together may be detached from each other so that the orientation of the pouch panels may be reversed. That is, the pouch panels may be turned inside out relative to each other so that the obverse surfaces of both the first and second panels are exposed and the reverse surfaces of the panels face each other. In this second orientation of the panels relative to each other the peripheral region of the cover that extends beyond the pocket region may be folded in toward the pocket region and compacted so that the entire peripheral region of the cover may be enveloped between the pair of panels and the pocket region of the cover. The releaseable fasteners are once again reengaged, thereby encapsulating the cover within the enclosed space defined by the two panels. The article of bedding thereby forms its own self-contained carrying case.

In some instances it may be desirable for both the first and second pouch panels to be formed of a waterproof or water repellent material. The article of bedding is thereby protected from rain and snow when carried outside in inclement weather.

When the pouch panels are disposed in their second orientation an article of bedding formed according to the present invention functions as a self-contained blanket or other cover and may also be used as a toss pillow or a cushion. When the cover is compacted within the enclosure formed between the two panels and the pocket region of the cover forming the opposing sides of the enclosure, the article may be handled extensively and serve as a pillow, cushion, or other soft support. The article may also be conveniently transported and moved from place to place in this compacted condition without danger of unfolding. On the other hand, when the releaseable fasteners are disengaged, the cover may be withdrawn completely from within the enclosure. The orientation of the pouch panels may again be reversed and the peripheral region of the cover may be spread from the pocket region to cover a desired area, such as an area on a bed or upon the floor.

In one broad aspect the present invention may be considered to be a self-storing bedding article comprising an expansive cover and a pouch formed with first and second panels. The cover has top and bottom surfaces and delineates a pocket region from a remaining peripheral region of the cover that projects outwardly from a demarcation boundary lying beyond the pocket region. Each of the pouch panels has an obverse and a reverse surface. The first and second pouch panels both have outer edges that are each permanently secured to the expansive cover along complementary portions of the demarcation boundary. In this way the pocket panels together overlie the pocket region of the cover completely. The first and second pocket panels also have linear, mutually parallel, overlapping free edges. The first and second panels may be oriented to reside with their obverse surfaces facing the top surface of the cover to form a pouch surmounting the top surface of the cover. In the alternative, the first and second panels are reversible and are positionable to reside with their obverse surfaces exposed, whereby the peripheral region of the expansive cover is foldable for insertion in between the reverse surfaces of the first and second panels and the pocket region of the cover for encapsulation therebetween.

Preferably, the first and second pouch panels both have a substantially rectangular shape and are permanently attached to the cover by stitches of thread completely along three of their sides. The fourth sides of the pouch panels are free and provide an access opening to the pocket formed with the top surface of the cover. The marginal portions of the pouch panels adjacent to their free edges overlap each other.

The pouch formed by the pouch panels and the pocket region of the cover is reversible. That is, the pouch may be turned inside out so that the reverse surfaces of the pouch panels face each other and the obverse surfaces of both pouch panels are exposed. When the panels are in this orientation, the peripheral portion of the cover can be folded in toward the bottom surface of the pocket region of the cover between the reverse surfaces of the pouch panels so that the cover can be folded and collapsed upon itself between the rear surfaces of the pouch panels and its own pocket region. The releaseable fasteners on the overlapping portions of the pouch panels can then be engaged to hold the entire cover in a compacted condition within the enclosed space defined between the first and second panels and the pocket region of the cover. Alternatively, the pouch panel orientation may be reversed relative to the cover so that the obverse surfaces of the panels face the pocket region of the cover. In this orientation of the pouch panels, the peripheral portion of the cover extends laterally outwardly from the pocket region of the cover and the second pouch panel overlaps the first pouch panel at the pocket region of the cover.

In a preferred arrangement, the releaseable fasteners are engageable with each other both when the reverse surfaces of the panels face each other and when the obverse surfaces of the panels face each other. This allows the pouch panels to be completely secured together throughout their edges irrespective of whether the obverse or reverse surfaces of the panels are in mutually facing relationship.

The cover itself is often rectangular with mutually parallel pairs of opposing cover edges. In some embodiments of the invention the pocket region of the cover at which the first and second pouch panels are secured to the cover is located adjacent one of the cover edges, typically midway between the two adjoining perpendicular cover edges. Alternatively, the pocket region may be centrally located in the cover. In such embodiments the peripheral region of the cover extends laterally in all directions from the pocket region.

In another aspect the invention may be considered to be a self-storing article of bedding comprising: an expansive cover having top and bottom surfaces and within which a pocket region is defined and which has a larger peripheral region extending beyond the pocket region, and a pouch. The pouch is formed of opposing first and second panels each having an obverse surface and a reverse surface. The first and second panels also both have boundary. edges that are permanently secured throughout to the cover to delineate an enclosing perimeter of the pocket region of the cover. The first and second panels each also have a free, linear edge. These free, linear, overlapping edges of the panels extended between their respective boundary edges to thereby divide the pocket region into a first area covered by the first panel, a second area covered by the second panel, and a third area covered. by both the first and second panels.

The panels are reversible between a first orientation in which their obverse surfaces face the pocket region of the cover and a second orientation in which their reverse surfaces face each other. When the pouch panels are in this second orientation the peripheral region of the cover is foldable toward the pocket region thereof. The peripheral region is collapsible for encapsulation between the first and second panels and the pocket region of the cover when the first and second panels are in the second orientation. The cover is alternatively withdrawable from between the first and second panels so that the peripheral region of the cover extends beyond the pocket region when the panels are in their first orientation previously described.

In a further broad aspect the invention may be considered to be a self-storing article of bedding comprising first and second pouch panels and an expansive cover formed of flexible fabric material having a top surface and in which a pocket area is delineated from a larger peripheral area. The first pouch panel has obverse and reverse surfaces overlying only a first portion of the pocket area. The first pouch panel is permanently secured about only a portion of its perimeter with the obverse surface thereof facing the top surface of the cover so as to leave a free, linear first pocket edge. The second pocket panel also has obverse and reverse surfaces and overlies the remaining portion of the pocket area beyond the first portion thereof. The second pocket panel is permanently secured about only a portion of its perimeter with the obverse surface thereof facing the top surface of the cover and also leaving a free, linear second pocket edge parallel to and overlapping the first pocket edge. In this way the pocket panels and the pocket area of the cover form a reversible pouch which resides atop the top surface of the cover when the obverse surfaces of the pocket panels are concealed facing the pocket area of the cover. Alternatively, when the pocket panels are reversed to expose their obverse surfaces, the peripheral area of the cover is foldable between the pocket panels for encapsulation between the reverse surfaces thereof and the pocket area of the cover.

The invention may be described with greater clarity and particularity by reference to the accompanying drawings.

DESCRIPTION OF THE EMBODIMENT

Figure 1:
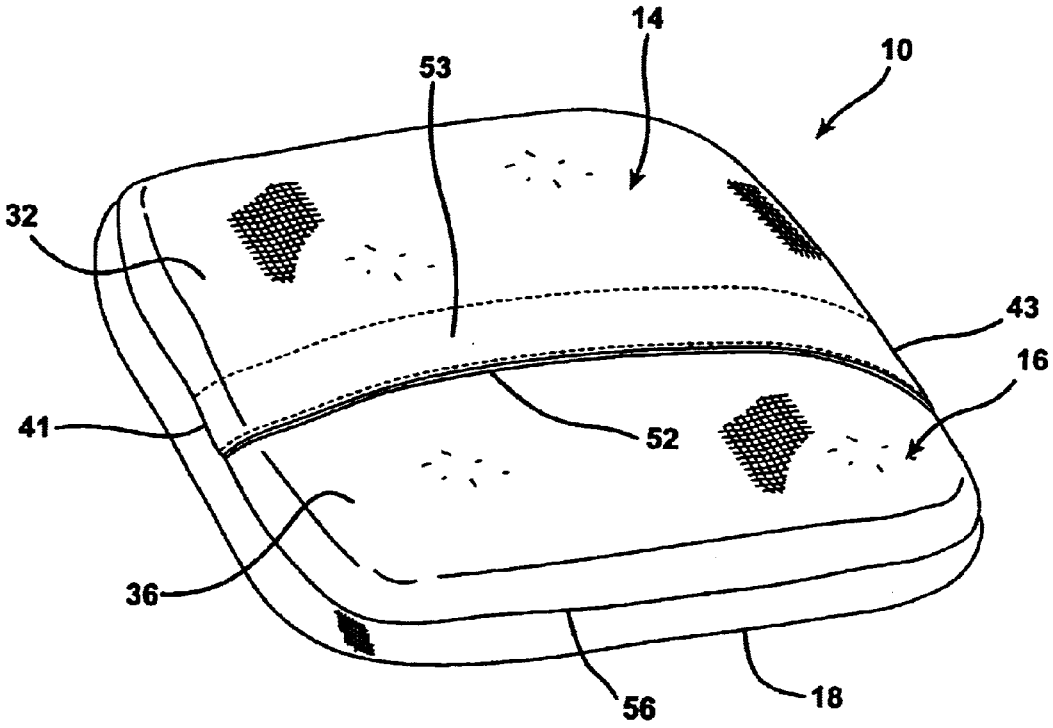
FIG. 1 is a perspective view of one embodiment of a self-storing bedding article according to the invention fully encased within its integral pouch.
Figure 2:
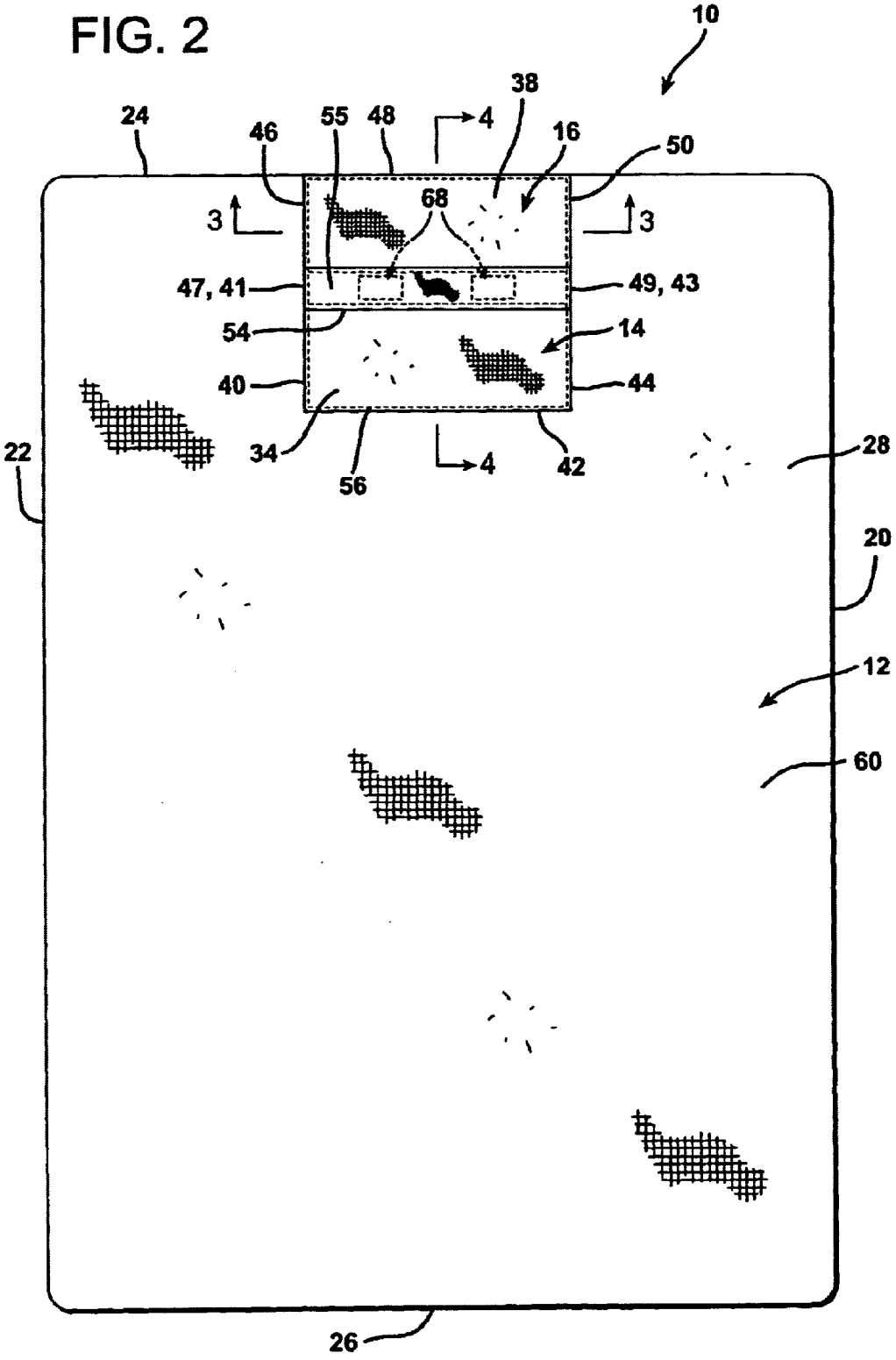
FIG. 2 illustrates the bedding article of FIG. 1 in which the cover has been withdrawn from the pouch panels and fully extended therefrom.
Figure 5:
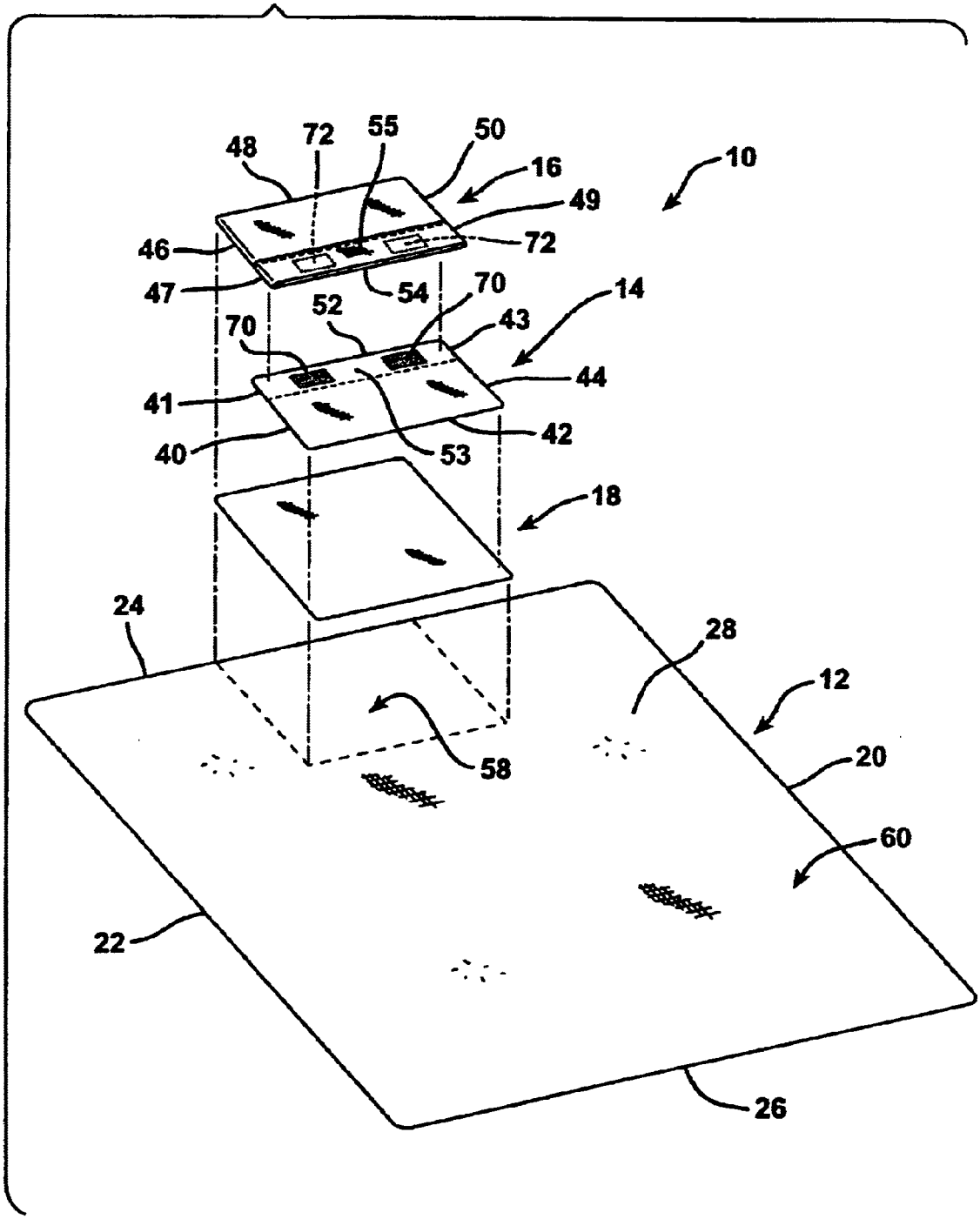
FIG. 5 is an exploded, perspective view of the bedding article shown in FIG. 2.

FIGS. 1 and 2 illustrate a self-storing bedding article in the form of a blanket indicated generally at 10. The blanket 10 is comprised of an expansive cover 12, a first water repellant pouch panel 14, a second water repellant pouch panel 16, and a water repellant pocket region protection sheet 18, as best illustrated in FIG. 5. The cover 12, the first and second pouch panels 14 and 16 and the pocket region protection sheet 18 are all rectangular in shape.

The blanket 12 is formed of a single layer of soft cotton or wool material, rectangular in shape and having mutually parallel opposing pairs of edges 20,22 and 24,26. The cover 12 may, for example, have measurements of about forty-six inches as measured along the top and bottom edges 24 and 26 by sixty-two inches, as measured along the side edges 20 and 22. The cover 12 has a top surface 28, visible in FIGS. 2 and 5, and an opposite bottom surface 30, indicated in FIGS. 3 and 4. The cover 12 is delineated into a pocket area 58 and a remaining peripheral area 60. The pocket area 58 is covered by the protective, rectangular, water repellent sheet 18 and is located midway along the top edge 24 of the cover 12. The pocket region of the cover 12 and the area of the protective sheet 18 are the same and are about fifteen inches wide as measured along the top edge 24 and twelve inches in length, as measured inwardly therefrom perpendicular to the top edge 24.

Figure 4:
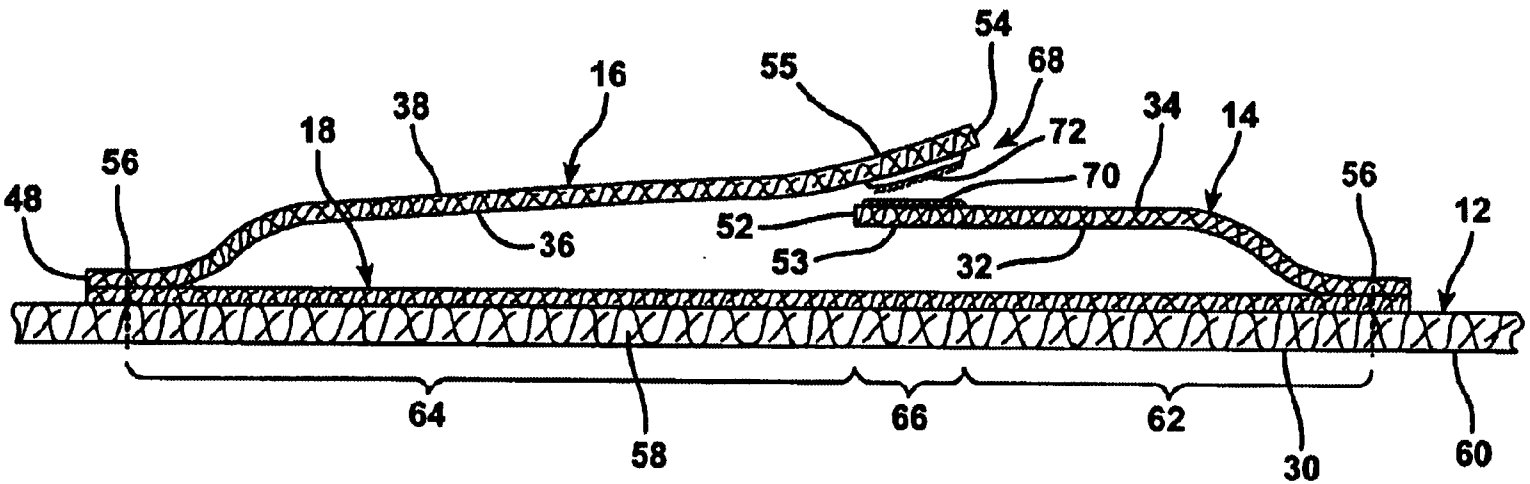
FIG. 4 is a sectional detail taken along the lines 4—4 of FIG. 2.

As illustrated in FIG. 4, both the first pouch panel 14 and the second pouch panel 16 have obverse and reverse surfaces. The obverse surface of the first pouch panel 14 is indicated at 32, while the reverse surface of the pouch panel 14 is designated as 34. The second pocket pouch panel 16 likewise has an obverse surface 36 and a reverse surface 38. Each of the pouch panels 14 and 16 is about fifteen inches in width and about seven inches in length.

The first pouch panel 14 has boundary edges 40, 42, and 44 while the second pouch panel 16 has boundary edges 46, 48, and 50. The first pouch panel 14 has a free, linear edge 52 extending between the boundary edges 40 and 44 so that a free first pouch panel edge margin 53 having opposing ends 41 and 43 exists on the first pouch panel immediately adjacent to the free edges 52 thereof. The second pouch panel 16 has a free, linear edge 54 extending between the boundary edges 46 and 50 so that a free second pouch panel edge margin 55 having opposing ends 47 and 49 exists on the second pouch panel immediately adjacent to the free edge 54 thereof.

Figure 3:
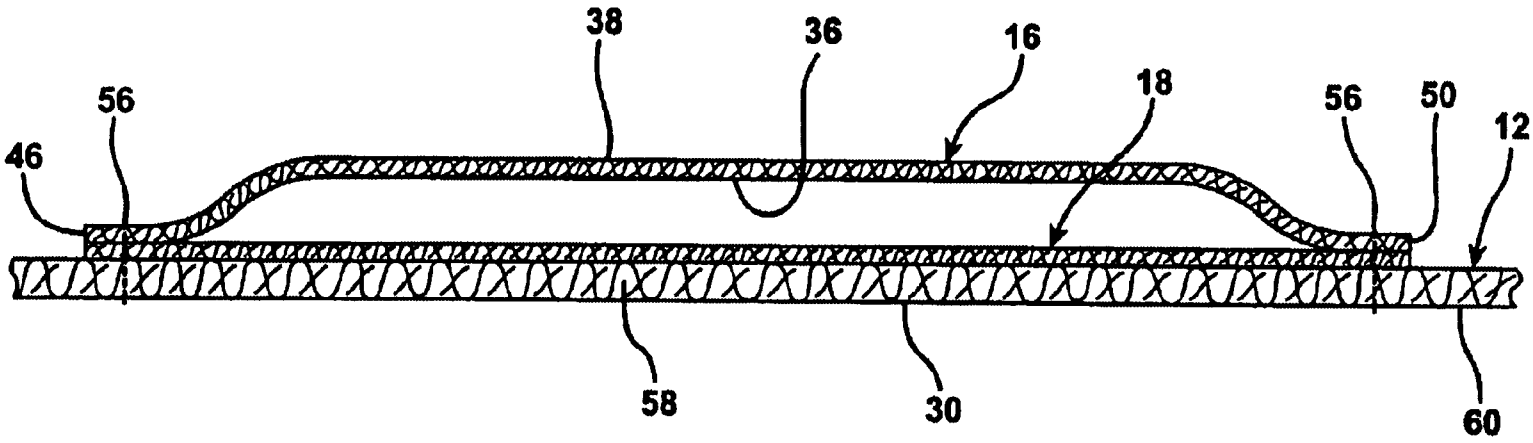
FIG. 3 is a sectional detail taken along the lines 3—3 of FIG. 2.

As illustrated in FIGS. 3 and 4, all of the boundary edges 40, 42, and 44 of the first pouch panel 14 and the boundary edges 46, 48, and 50 of the second pouch panel 16 including the common overlapping portions of those edges where the ends 41 and 43 of the free edge margin 53 and the ends 47 and 49 of the free edge margin 55, are secured to the cover 12. These pouch panel edges are secured through the edge margins of the protective sheet 18 by stitching with thread, indicated at 56. The rectangular line of thread stitching 56 delineates the enclosing perimeter of the pocket region 58 of the cover 12 from the remaining, peripheral region 60 thereof. As illustrated, the pocket region 58 of the cover 12 is much smaller than the peripheral region 60.

As best illustrated in FIG. 4, the free, linear edges 52 and 54 of the first and second pouch panels 14 and 16, respectively, mutually overlap to divide the pocket region 58 of the cover 12 into a first area 62 about fifteen inches wide and five inches in length covered by the first panel 14, a second area 64 about fifteen inches wide and about five inches in length covered by the second panel 16, and a third area 66, about fifteen inches wide and two inches in length covered by both the first panel 14 and the second panel 16. The end 41 of the free edge margin 53 of the first panel 14 and the end 47 of the free edge margin 55 of the second panel 16 are secured in overlapping fashion on the side of the third area 66 at which the boundary edges 40 and 46 meet and overlap. The end 43 of the free edge margin 53 of first panel 14 and the end 49 of the free edge margin 55 of the second panel 16 are secured in overlapping fashion on the side of the third area 66 at which the boundary edges 44 and 50 meet and overlap. The free side edge margins 53 and 55 thereby both overlap and cover the third area 66 at opposing locations on the demarcation boundary of the pocket region 58.

As illustrated in FIG. 4, the first and second panels 14 and 16 are provided with mutually engageable, releaseable fasteners indicated generally at 68 where they overlap each other. The fasteners 68 are formed of flexible, fabric hook and loop fastening elements of the type sold under the registered trademark Velcro®. More specifically, each pouch panel 14 and 16 is provided with a pair of fastener elements. The first fastener elements 70 are located on the reverse surface 34 of the first panel 14, while a pair of the second fastener elements 72 are located on the obverse surface 36 of the second panel 16. The first fastener elements 70 are comprised of rectangular patches of dense, looped fabric pile sewn onto the reverse surface 34 of the first pouch panel 14 at laterally spaced intervals proximate the free edges 52 of the first pouch panel 14. The second fastener elements 72 are formed of rectangular patches bearing a multiplicity of minute, flexible fabric hooks sewn onto the obverse surface 36 of the second pouch panel 16. The second fastener elements 72 are likewise spaced at corresponding locations proximate the free edge 54 of the second house panel 16 in alignment with the first fastener elements 70. The first and second fastener elements 70 and 72 are thereby located at positions on the first and second pouch panels 14 and 16, respectively, in the mutually overlapping areas thereof. The flexible, fabric hooks of the second fastener elements 72 are engageable in the pile of the first fastener elements 70 when the first and second fastener elements 70 and 72 are brought into contact with each other.

Both the first panel 14 and the second panel 16 are reversible. That is, they may be oriented to reside with their respective obverse surfaces 32 and 36 facing the top surface 28 of the cover 12 in registration with the pocket region 58 of the cover 12. Alternatively, the pouch or pocket located beneath the first and second panels 14 and 16 may be turned inside out from the first orientation illustrated in FIGS. 2, 3, and 4 to a second orientation illustrated in FIGS. 1 and 11 in which the obverse surfaces 32 and 36 of the first and second pouch panels 14 and 16, respectively, are exposed and the reverse surfaces 34 and 38 thereof face each other. With the pouch panels 14 and 16 in this second orientation, the peripheral region 60 of the expansive cover 12 is foldable for insertion in between the reverse surfaces 34 and 38 of the first and second pouch panels 14 and 16 and the pocket region 58 of the cover 12 for encapsulation therebetween.

Figure 6:
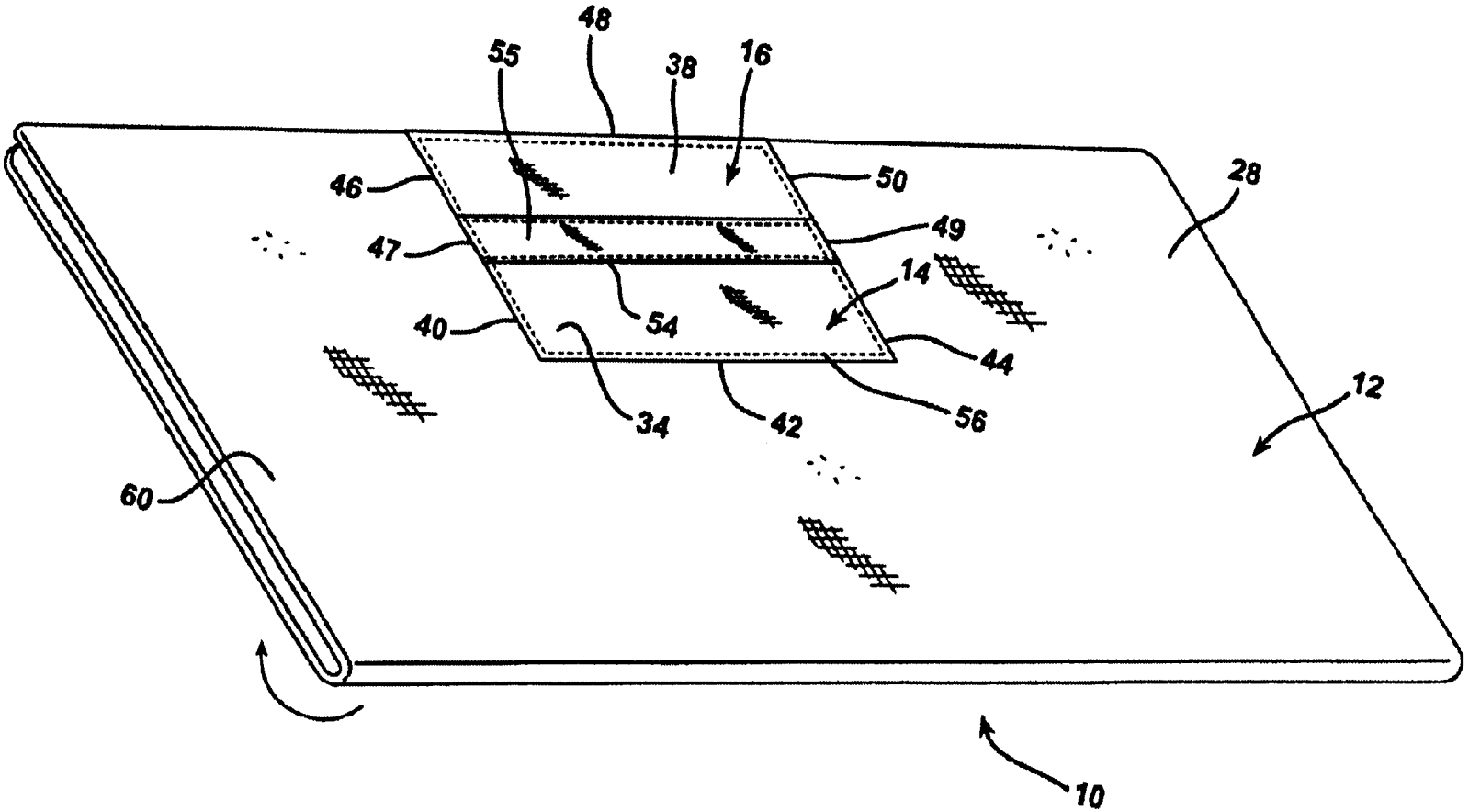
FIG. 6 is a perspective view showing the cover of the bedding article of FIG. 1 with an initial fold prior to encapsulation.
Figure 7:
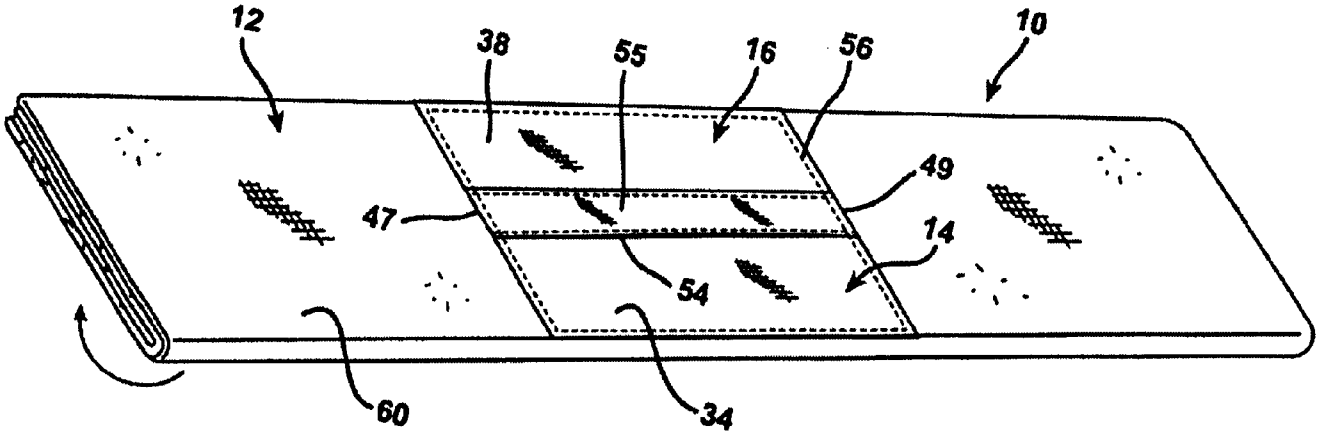
FIG. 7 illustrates the next step in folding the cover for encapsulation.
Figure 8:
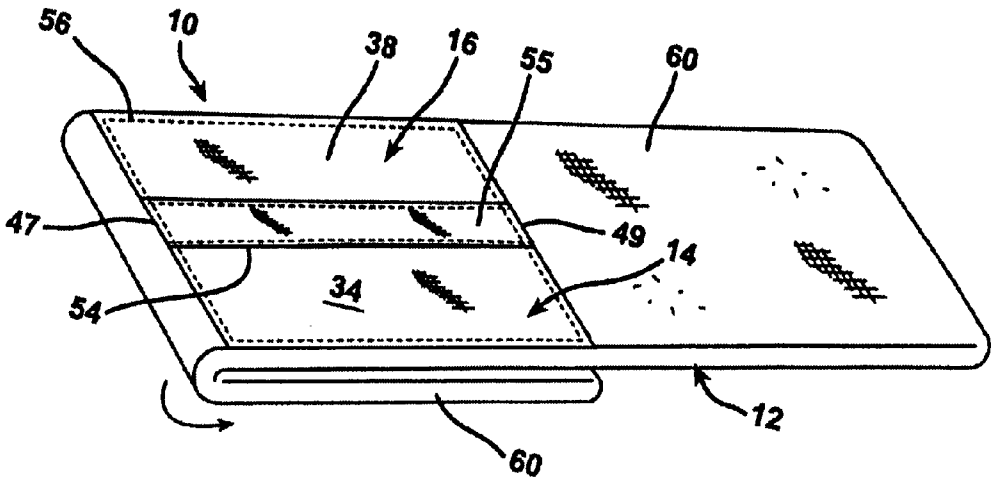
FIG. 8 illustrates the cover being folded further from the position illustrated in FIG. 7.
Figure 9:
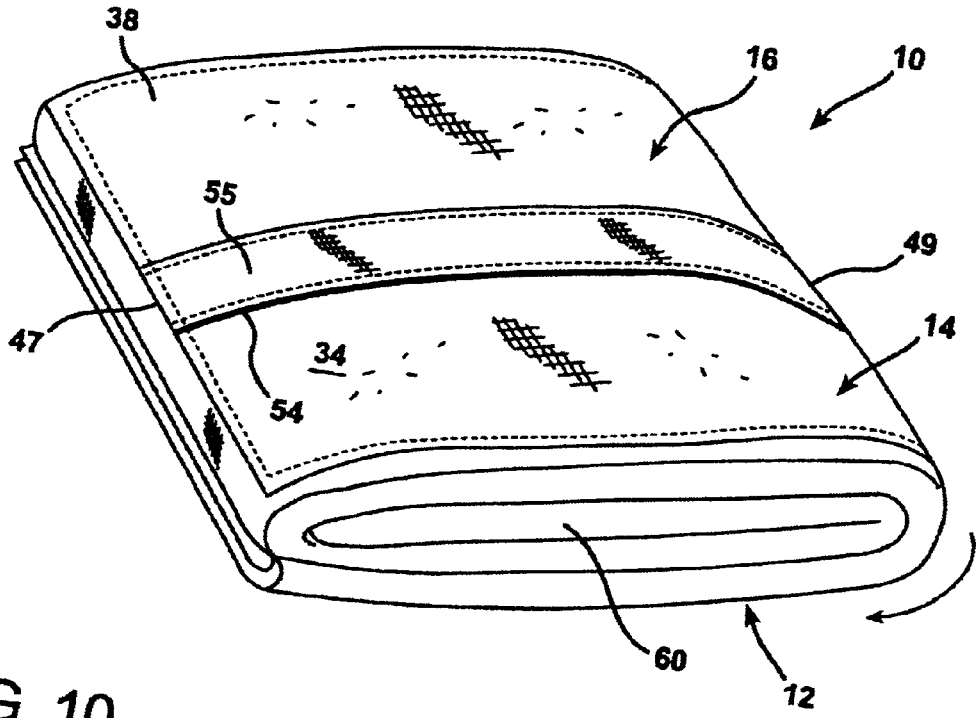
FIG. 9 illustrates the cover completely folded prior to-encapsulation.
Figure 10:
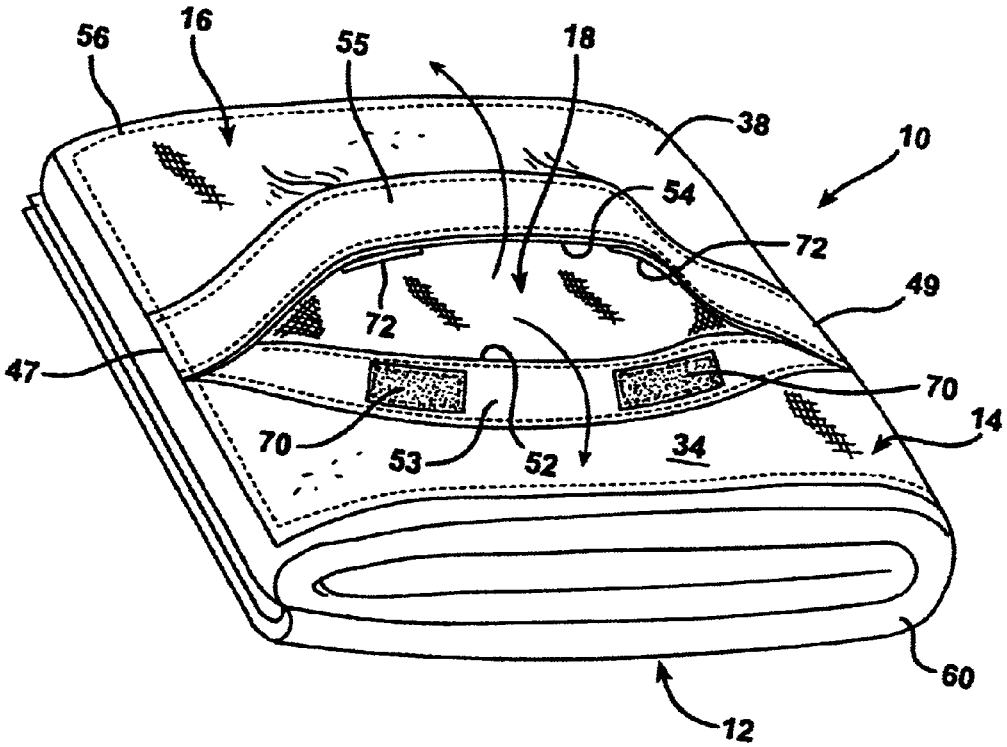
FIG. 10 illustrates the reversal in orientation of the pouch panels from a first orientation toward a second orientation.
Figure 11:
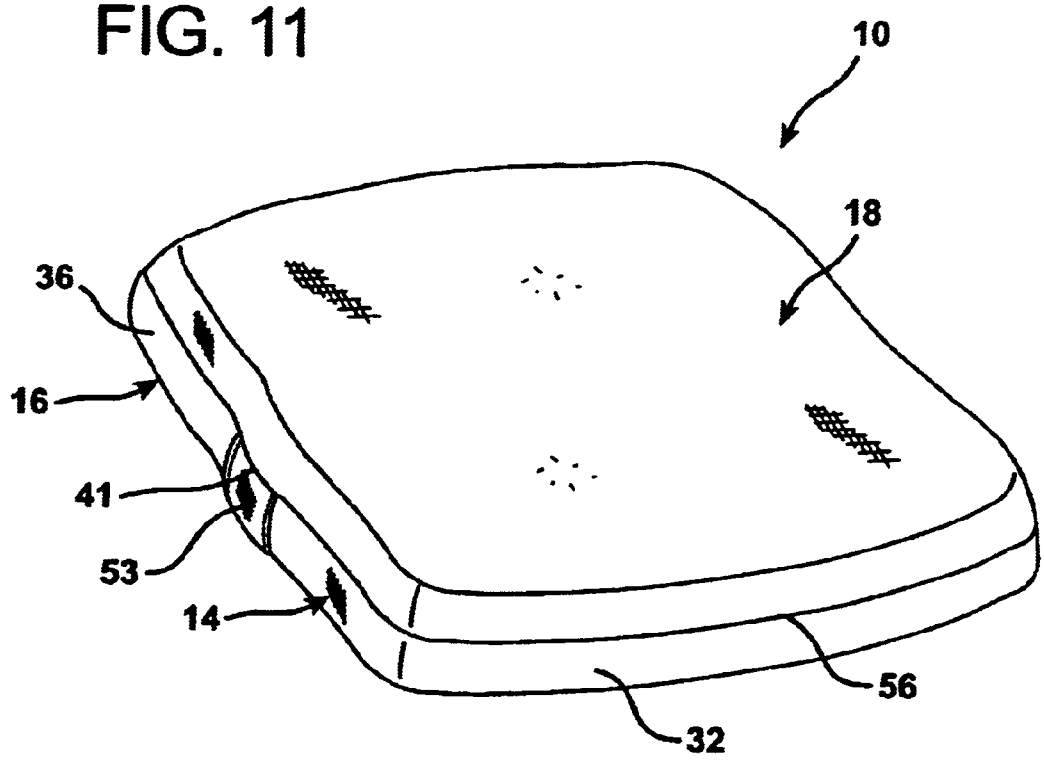
FIG. 11 illustrates the pouch folded completely inside out with the pouch panels in their second orientation.
Figure 12:
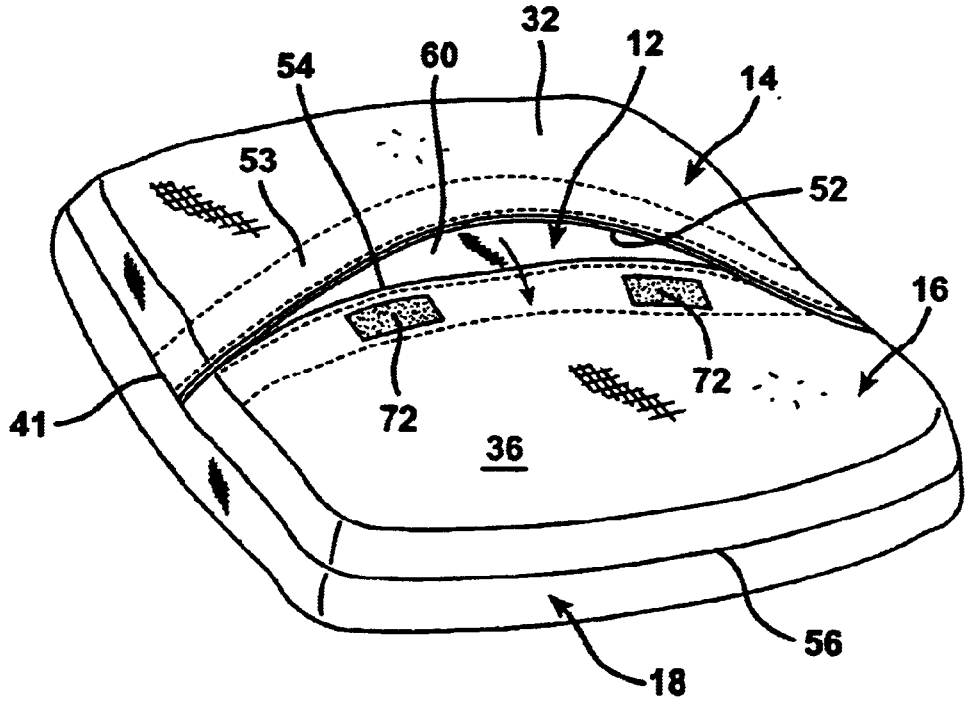
FIG. 12 illustrates the final step of securing the releaseable fasteners of the pouch panels in order to return the bedding article to the condition illustrated in FIG. 1.

Drawing FIGS. 6 through 12 illustrate how the peripheral region 60 of the cover 12 may be folded and collapsed for encapsulation. As illustrated in FIG. 6, the cover 12 is first folded in half along a fold line parallel to the top and bottom edges 24 and 26 thereof while keeping the pouch panels 14 and 16 exposed. As shown in FIG. 7, the cover 12 is doubled over along a folding line extending in the same direction once again. The marginal portions of the cover 12 then located on either side of the pouch panels 14 and 16 are then sequentially folded one beneath another, as illustrated in FIGS. 8 and 9. As shown in FIG. 9, the pouch panels 14 and 16 are still in their first orientation, but with the cover 12 folded completely therebeneath. As illustrated in FIG. 10, the orientation of the pouch panels 14 and 16 is then reversed. That is, the first and second fastener elements 70 and 72 are first detached from each other. The free ends 52 and 54 of the pouch panels 14 and 16, respectively, are pulled outwardly away from each other and over the ends of the pocket region 58 of the cover 12. Once the pocket or pouch initially formed between the pouch panels 14 and 16 and the top surface 28 of the cover 12 at the pocket region 58 thereof has been turned inside out, the obverse surfaces 32.and 36 of the pouch panels 14 and 16 are fully exposed and the peripheral region 60 of the cover 12 is encapsulated between the reverse surfaces 34 and 38 of the pouch panels 14 and 16 and the pocket region 58 of the cover 12, as illustrated in FIG. 11.

The bedding article 10 is then turned over from the position illustrated in FIG. 11 to the position illustrated in FIG. 1, and the releaseable fastener elements 70 and 72 are then reengaged with each other. It should be noted that the mating fastener elements 70 and 72 of the releaseable fasteners 68 are mutually engageable with each other both when the obverse surfaces 32 and 36 of the panels 14 and 16 face the pocket region 58 of the cover 12 and when the obverse surfaces 32 and 36 of the panels 14 and 16 are exposed with the peripheral region 60 of the cover 12 fully encapsulated. In this orientation the protective sheet 18, initially concealed beneath the pouch panels 14 and 16, is fully exposed. Its water repellent surface serves to protect the cover 12 from moisture. Similarly, the first and second pouch panels 14 and 16 are also formed of a water repellent material. Thus the peripheral region 60 of the cover 12 may be completely collapsed and encapsulated when the first and second pouch panels 14 and 16 are in the second orientation, illustrated in FIGS. 1 and 11.

Figure 13:
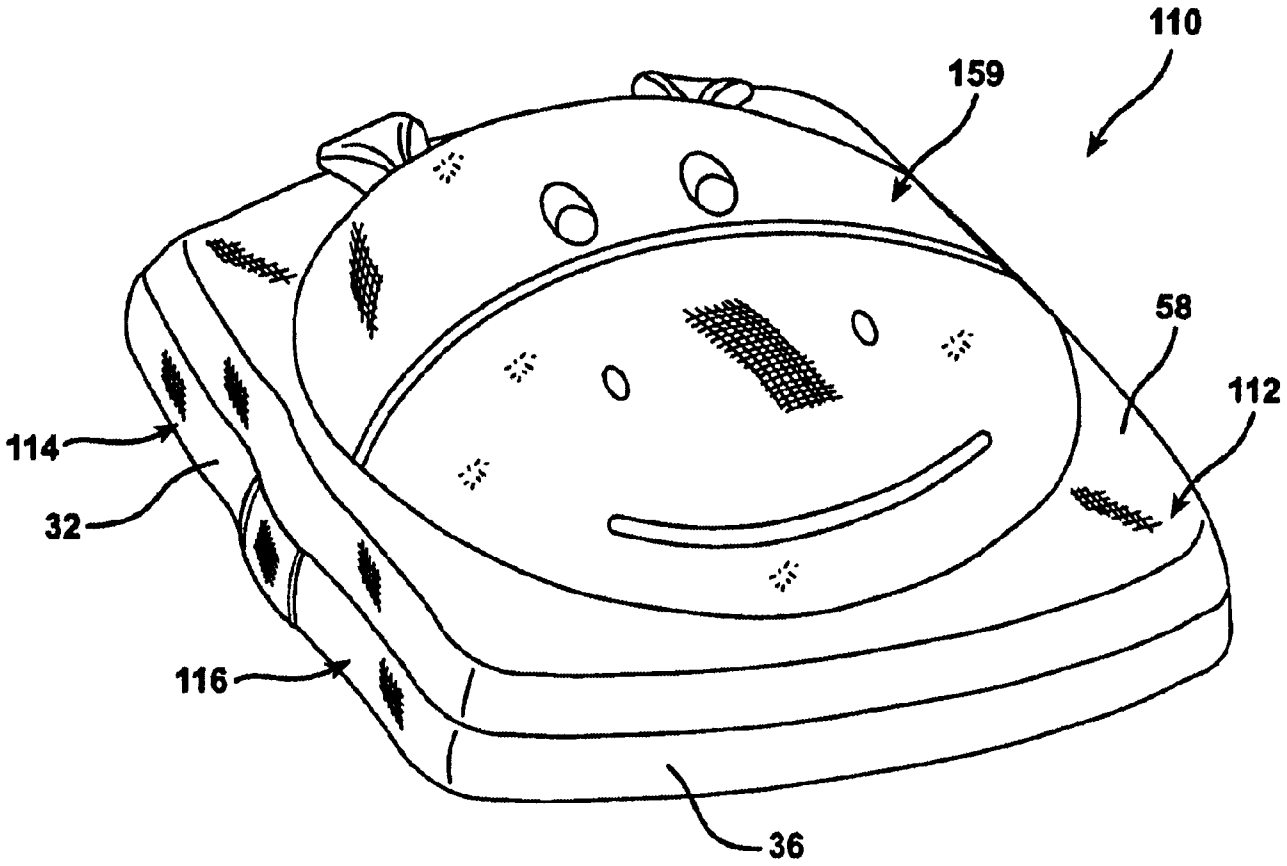
FIG. 13 illustrates an alternative embodiment of a self-storing bedding article constructed according to the invention in its compacted, encapsulated condition.
Figure 14:
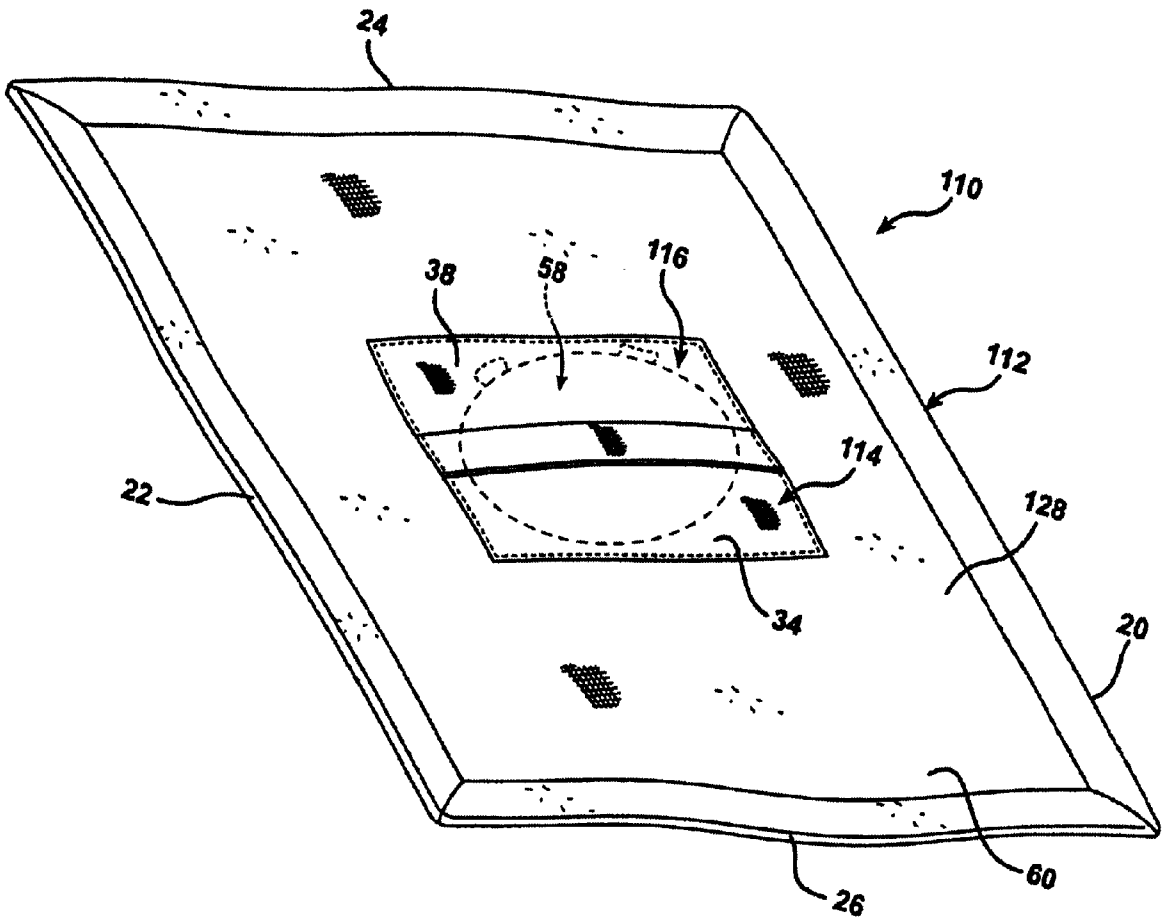
FIG. 14 is a perspective view of the bedding article of FIG. 13 shown with the cover thereof fully extended and the pouch panels in their first orientation.
Figure 15:
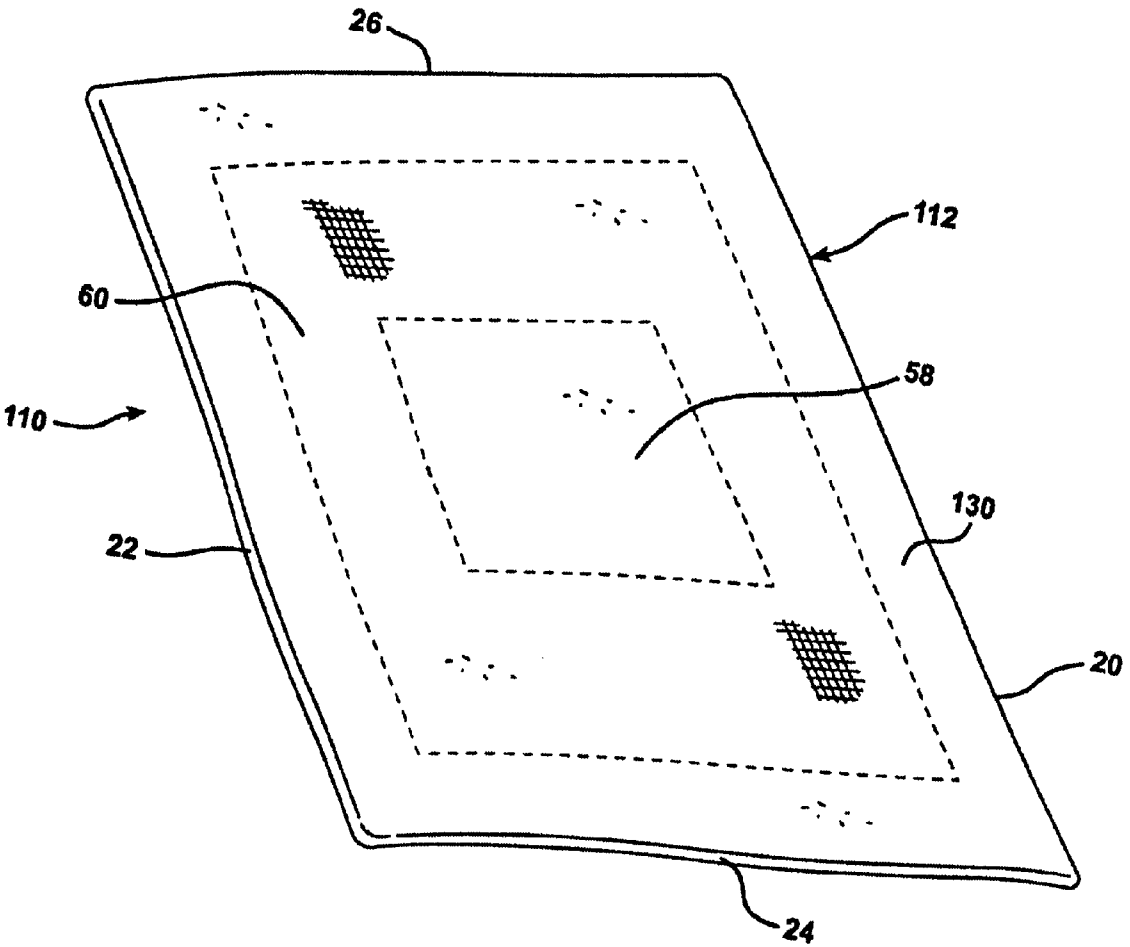
FIG. 15 is a perspective view that illustrates the underside of the bedding article of FIG. 14.

Drawings FIGS. 13 through 20 illustrate an alternative article of bedding 110 according to the invention, which is a comforter having a cover 112 formed of a plurality of sheets of fabric sewn together around their outer edges. As illustrated in FIG. 15, the cover 112 includes a bottom ply 130 of soft, flexible fabric material sewn about its edges to a top layer of fabric material 128, visible in FIG. 14. The comforter 110 includes a first fabric pouch panel 114 and a second fabric pouch panel 116.

The first and second pouch panels 114 and 116 respectively have concealed surfaces 32 and 36 and reverse surfaces 34 and 38, as in the bedding article 10 illustrated in FIGS. 1 through 12. Likewise, the first and second pouch panels 114 and 116 are respectively provided with first fastener elements 70 and second fastener elements 72 as in the other embodiment of the invention illustrated.

The bedding article 110 of drawing FIGS. 13 through 20 differs from the bedding article 10 in several respects, however. Specifically, the pocket region 58 of the cover 112 is centrally located in the cover 112 of the comforter 110. The cover 112 has top and bottom edges 24 and 26 and side edges 20 and 22. However, the comforter is only about forty inches in length as measured along the side edges 20 and 22 and twenty-six inches in width, as measured along the top and bottom edges 24 and 26. The pocket area 58 of the comforter 110 is centrally located and is about thirteen and half inches in width, as measured parallel to the top and bottom edges 24 and 26, and thirteen inches in length, as measured parallel to the side edges 20 and 22.

The peripheral region 60 of the cover 112 is likewise capable of complete encapsulation between the first and second pouch panels 114 and 116 and the pocket region 58 of the cover 112. However, because the pocket region 58 in the cover 112 is centrally located, the folding technique is a bit different.

As illustrated in FIG. 14, the comforter 110 may be deployed for use as a bedding article with the first and second pouch panels 114 and 116 in their first orientation facing the top layer 128 of the cover 112 and overlying the pocket region 58. With the releaseable hook and loop fabric fasteners 68 engaged, the comforter 110 is ready for use as a bedding article. Small, soft items, such as a pacifier or an extra diaper may be stored in the pocket created beneath the first and second pouch panels 114 and 116 and the underlying pocket region 58 of the cover 112.

Figure 16:
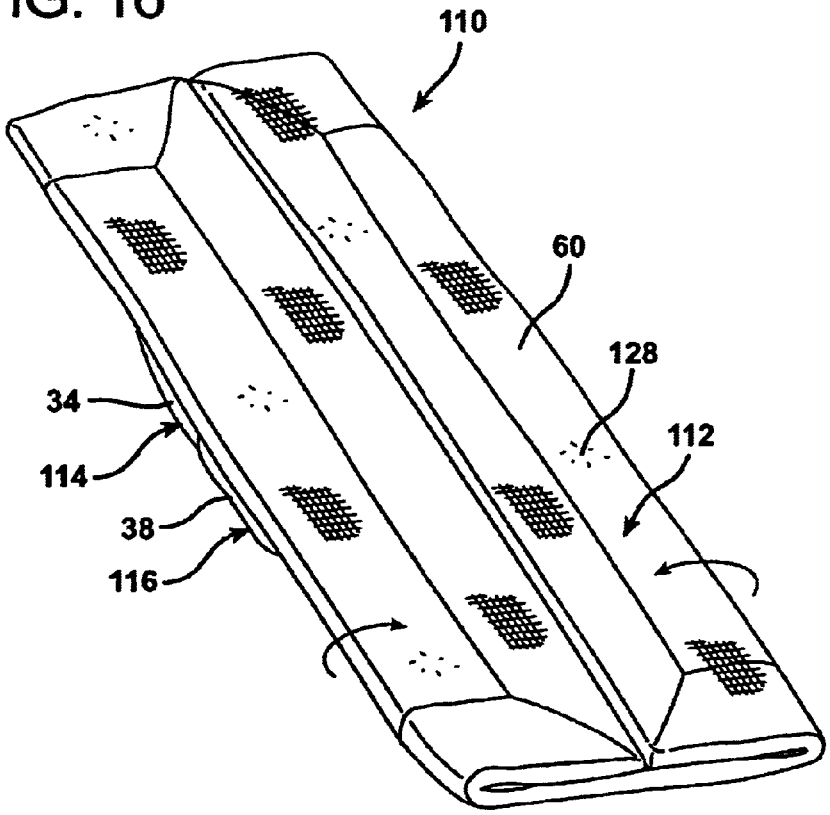
FIG. 16 illustrates the initial steps of folding the cover of the bedding article of FIG. 14 in preparation for encapsulation of the cover thereof.
Figure 17:
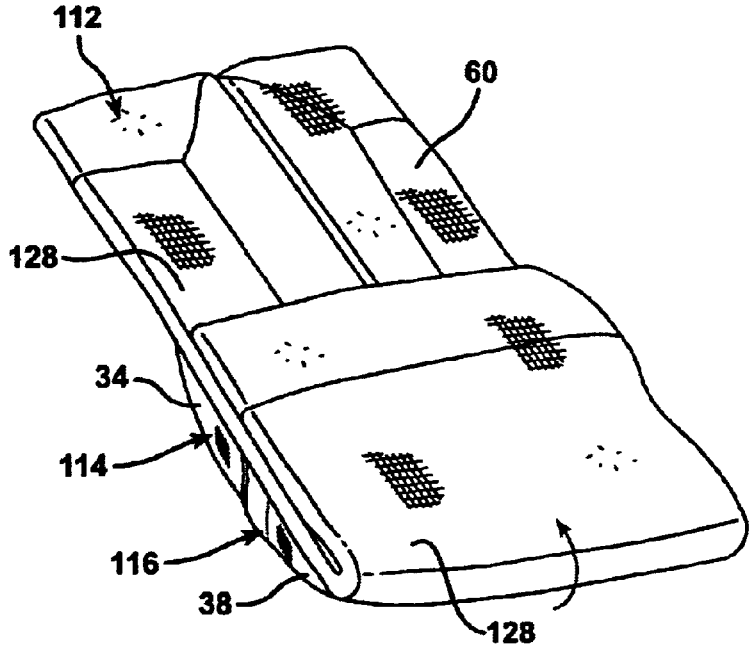
FIG. 17 is a perspective view illustrating the next step in folding the cover from the condition shown in FIG. 16.
Figure 18:
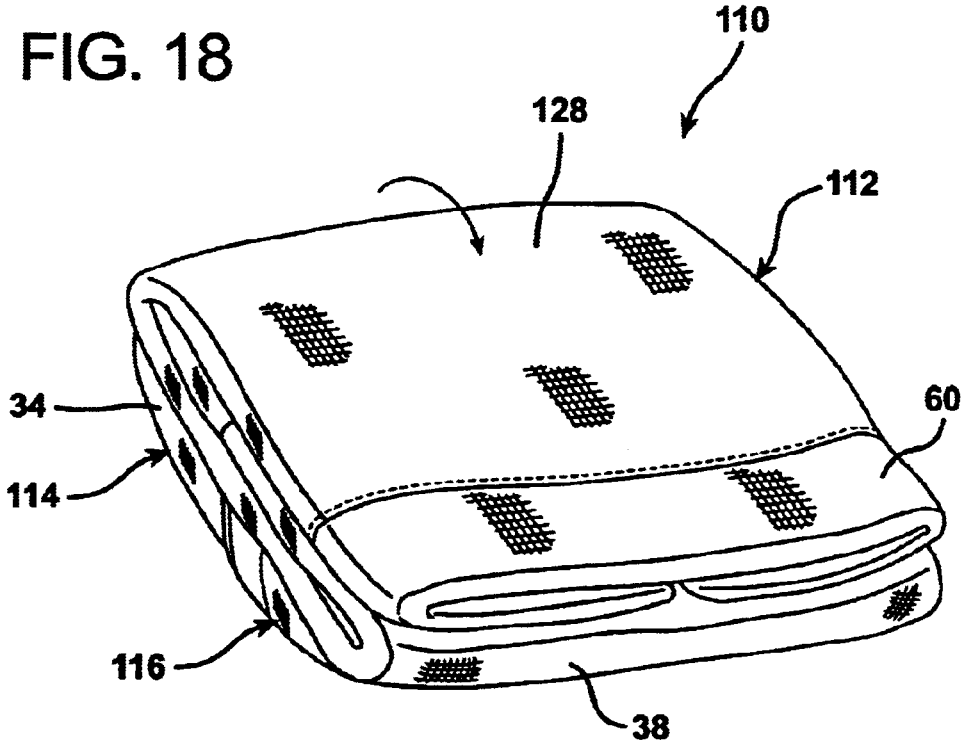
FIG. 18 illustrates the bedding article of FIG. 14 completely folded in preparation for self-encapsulation.

To store the cover 112, the bedding article 110 is first turned over from the position of FIG. 14 to the position of FIG. 15. The longitudinal marginal portions of the cover 112 are then folded inwardly toward the center of the bedding article 110, parallel to the side edges 20 and 22, as illustrated in FIG. 16. The end portions of the cover 112 are then folded inwardly on top of the pocket region 58 of the cover 112, as illustrated in the sequential steps shown in FIGS. 17 and 18.

Figure 19:
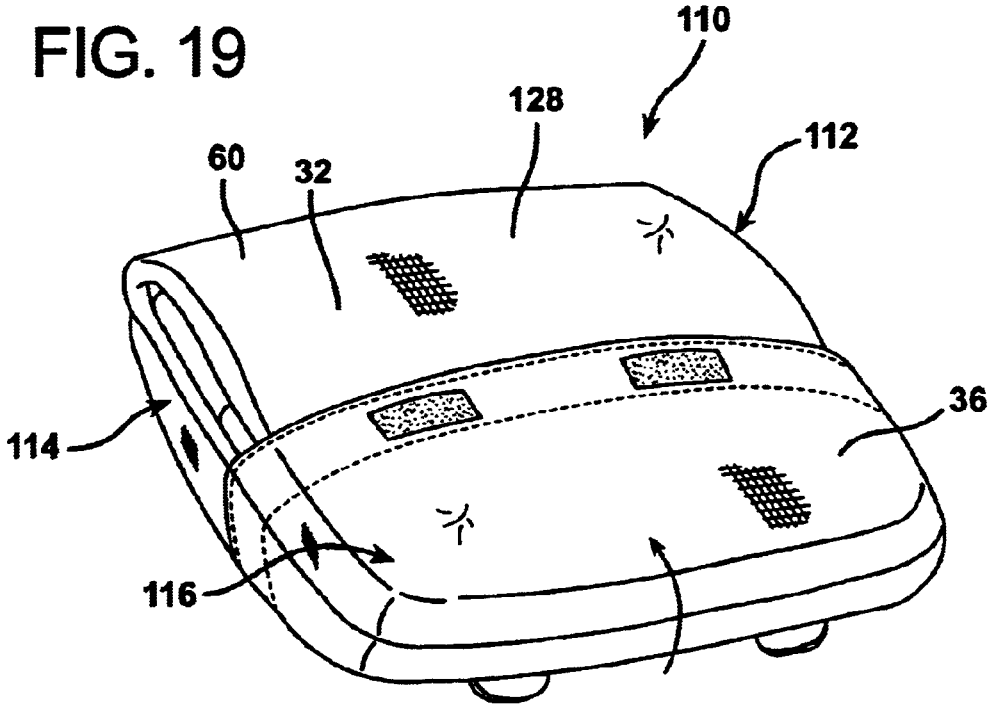
FIG. 19 illustrates the bedding article of FIG. 14 with the first pouch panel returned to its first orientation while the second pouch panel still resides in its second orientation.
Figure 20:
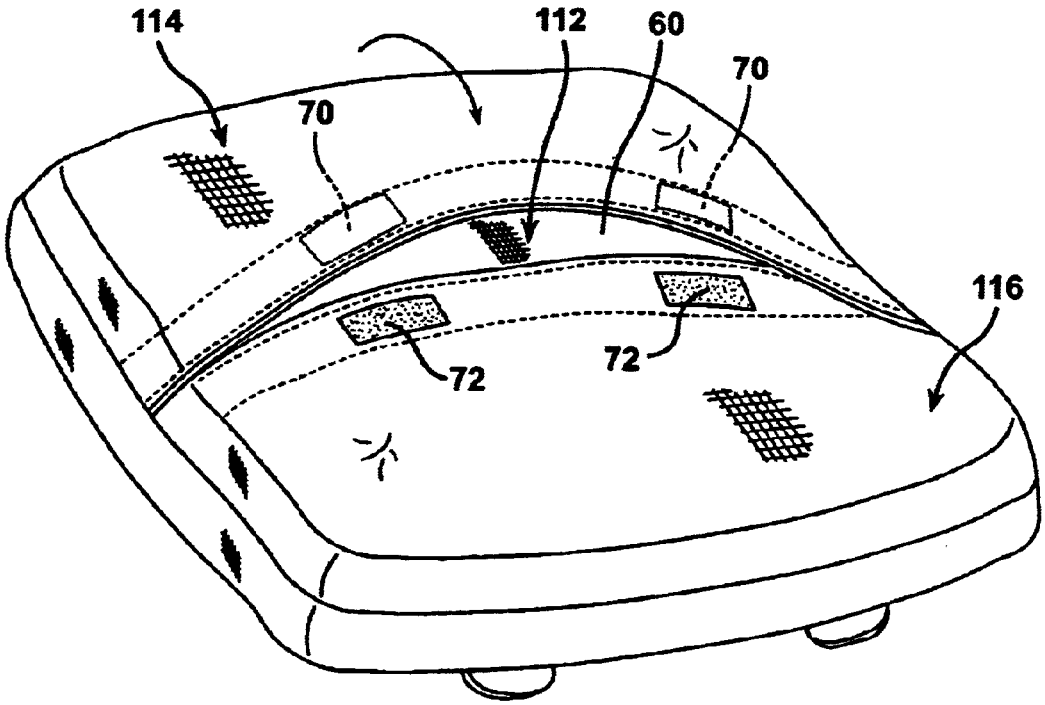
FIG. 20 illustrates the bedding article of FIG. 14 with both pouch panels residing in their second orientation and just prior to engagement of the releaseable fasteners to return to the bedding article to the compacted condition shown in FIG. 13.

The orientation of the first and second pouch panels 114 and 116 is then reversed from the first orientation illustrated in FIG. 14 in which the obverse surfaces 32 and 36 face the underlying pocket region 58 of the cover 112. Specifically, the fastener elements 70 and 72 of the releaseable fasteners 68 are separated from each other and the pouch formed when the pouch panels 114 and 116 are in their first orientation is turned inside out. That is, the second pouch panel 116 is turned inside out and pulled around one end of the folded cover 112, as shown in FIG. 19. The first pouch panel 114 is then also turned inside out and pulled over the other end of the folded cover 112 to encapsulate the peripheral portion 60 of the cover 112 thereof between the first and second pouch panels 114 and 116 and the pocket region 58 of the top layer 128 of the cover 112, as illustrated in FIG. 20. The releaseable fastener elements 70 and 72 are then reengaged and the fully compacted bedding article 110 may be conveniently transported and stored with the cover 112 maintained in its tightly folded condition.

The first and second pouch panels 114 and 116 and the top and bottom layers 128 and 130 of the cover 112 are all formed of the same soft, flexible fabric material which may, for example, be cotton or polyester. As illustrated in FIG. 13, the top surface of the top layer 128 of the cover 112 is provided with surface ornamentation on the central, pocket region 58 thereof. In the embodiment shown, this surface ornamentation is in the form of a friendly hippopotamus face, indicated at 159. The surface ornamentation 159 is formed of a circular patch of soft fabric that forms the outline of the face, and smaller fabric patches that form the projecting ears and the facial features of the decorative ornamentation 159.

Undoubtedly, numerous variations and modifications of the invention will become readily apparent to those familiar with bedding and other sheet-like fabric materials that require storage. The invention is not limited to blankets and comforters, or the like. To the contrary, the invention has equal applicability to sleeping bags, beach towels, and other articles of manufacture that may be constructed in the same way.

Also, fasteners other than flexible hook and loop fabric fasteners may be employed to form the releaseable closure mechanism of the invention. For example, zippers, snap fasteners, and buttons may be utilized in place of the hook and loop fabric fasteners illustrated in the embodiments shown. In addition both the expansive cover and the pouch can have a variety of shapes. Either or both can be square, rectangular, round, or any other shape. Accordingly, the scope of the invention should not be construed as limited to the specific embodiments depicted and described, but rather is defined in the claims appended hereto.

I claim:

1. A self-storing bedding article comprising:

an expansive cover having top and bottom surfaces and delineating a pocket region and a remaining peripheral region that projects outwardly from a demarcation boundary beyond said pocket region, a pouch formed with first and second panels each having an obverse and a reverse surface and said first and second panels both have outer edges that are each permanently secured to said expansive cover along portions of said demarcation boundary, whereby together said first and second panels overlie said pocket region of said cover completely, and said first and second panels have linear, mutually parallel overlapping free edges and overlapping free edge margins immediately against said free edges and said overlapping free edge margins both have opposing ends that are permanently secured to said expansive cover in overlapping fashion at opposing locations on said demarcation boundary, whereby a first area of said pocket region is defined that is covered by only said first panel, a second area of said pocket region is defined that is covered only by said second panel, and a third area of said pocket region is defined beneath said overlapping free edge margins that is covered by both said first panel and said second panel, and said first and second panels may be oriented to reside with their obverse surfaces facing said top surface of said cover to form a pouch surmounting said pocket region at said top surface of said cover and in the alternative are reversible so that said first and second panels are positionable to reside with their obverse surfaces exposed, whereby said peripheral region of said expansive cover is foldable for insertion in between said reverse surfaces of said first and second panels and said pocket region of said cover for encapsulation therebetween.

2. A self-storing bedding article according to claim 1 further characterized in that said panels are each provided with mutually engageable releaseable fasteners proximate their free edges.

3. A self-storing bedding article according to claim 2 further characterized in that said releaseable fastener of said first panel is located on said reverse surface and adjacent said free edge thereof, and said releaseable fastener of said second panel is located on said obverse surface and adjacent said free edge thereof, whereby said releaseable fasteners are mutually aligned and engageable with each other both when said obverse surfaces of said panels face said top surface at said pocket region of said cover and when said obverse surfaces of said panels are exposed with said peripheral region of said cover fully encapsulated.

4. A self-storing bedding article according to claim 3 wherein said releaseable fasteners are formed of flexible, fabric hook and loop fastening elements.

5. A self-storing bedding article according to claim 1 wherein said cover is rectangular in shape with mutually parallel pairs of opposing cover edges and said pocket region is located adjacent one of said cover edges.

6. A self-storing bedding article according to claim 1 wherein said pocket region is centrally located in said cover, and said peripheral region extends laterally in all directions from said pocket region.

7. A self-storing bedding article according to claim 1 further comprising a plurality of sets of mutually engageable releaseable fasteners having first and second releaseably engageable elements, and further characterized in that said first fastener elements are located on said first panel on said reverse surface and adjacent said free edge thereof, and said second fastener elements are located on said second panel on said obverse surface and adjacent said free edge thereof, whereby said sets of releaseable fasteners are mutually engageable with each other both when said obverse surfaces of said panels face said top surface at said pocket region of said cover and when said obverse surfaces of said panels are exposed with said peripheral region of said cover encapsulated.

8. A self-storing bedding article according to claim 1 wherein said first and second panels are formed of a water repellant material and further comprising a water repellant protection sheet secured to said top surface over said pocket region of said cover.

9. A self-storing bedding article according to claim 1 wherein said cover has a surface ornamentation formed on said top surface at said pocket region thereof.

10. A self-storing article of bedding comprising:

an expansive cover having top and bottom surfaces and within which a pocket region is defined and which has a larger peripheral region extending beyond said pocket region, a pouch formed of opposing first and second panels each having an obverse surface and a reverse surface, and said first and second panels both have boundary edges that are permanently secured throughout to said cover to delineate an enclosing perimeter of said pocket region of said cover and free, linear, overlapping edges extending between their respective boundary edges and free edge margins immediately adjacent said free edges, and said overlapping free edge margins both have opposing ends that are permanently secured to said expansive cover in overlapping fashion at opposing locations on said encircling perimeter to thereby divide said pocket region into a first area covered by said first panel, a second area covered by said second panel, and a third area covered by both said first and second panels and bounded by said ends of said free edge margins and by said free edges of both said first and second panels, and said panels are reversible between a first orientation in which their obverse surfaces face said pocket region of said cover and a second orientation in which their reverse surfaces face each other and said peripheral region of said cover is foldable toward said pocket region thereof and collapsible for encapsulation between said first and second panels and said pocket region of said cover when said first and second panels are in said second orientation, and said peripheral region of said cover is alternatively withdrawable from said first and second panels so that said peripheral region of said cover extends beyond said pocket region when said panels are in said first orientation.

11. A self-storing article of bedding according to claim 10 wherein said first and second panels are provided with mutually engageable releaseable fasteners where they overlap each other.

12. A self-storing article of bedding according to claim 11 wherein said mutually engageable fasteners include a first element formed of a multiplicity of loops of fabric pile and a second element having a multiplicity of minute, flexible fabric hooks, and said hooks are engageable in said pile when said first and second elements are placed in contact with each other.

13. A self-storing article of bedding according to claim 12 wherein said panels are permanently secured to said cover by stitching together said panels and said cover with thread.

14. A self-storing article of bedding according to claim 10 wherein said cover has four peripheral edges and is rectangular in shape and said pocket region is located midway along one of said cover edges.

15. A self-storing article of bedding according to claim 10 wherein said pocket region is laterally surrounded on all sides by said peripheral region of said cover.

16. A self-storing article of bedding comprising:

an expansive cover formed of flexible fabric material having a top surface and in which a pocket area is delineated from a larger peripheral area by a pocket perimeter, a first pouch panel having obverse and reverse surfaces overlying only a first portion of said pocket area and permanently secured about only a first portion of said pocket perimeter with said obverse surface thereof facing said top surface of said cover and leaving a free, linear first pocket panel open edge with a first pocket panel open edge margin located immediately adjacent thereto, and a second pocket panel having obverse and reverse surfaces overlying the remaining portion of said pocket area beyond said first portion thereof and permanently secured about only a second portion of said pocket perimeter with said obverse surface thereof facing said top surface of said cover and leaving a free, linear second pocket panel open edge parallel to said first pocket panel open edge and said second pocket panel open edge has a second pocket panel open edge margin located immediately adjacent thereto and overlapping said first pocket panel open edge margin, and said first and second pocket panel open edge margins both have opposing ends that are secured in overlapping fashion across said pocket area of said expansive cover, so that said first and second portions of said pocket perimeter have common opposing sections to which both said first and second pocket panels are secured, whereby said pocket panels and said pocket area of said cover form a reversible pouch which resides atop said top surface of said cover when said obverse surfaces of said pocket panels are concealed facing said pocket area of said cover, and alternatively, when said pocket panels are reversed to expose their obverse surfaces, said peripheral area of said cover is foldable between said pocket panels for encapsulation between said reverse surfaces thereof and said pocket area of said cover.

17. A self-storing article of bedding according to claim 16 wherein said panels are both provided with mutually engageable releaseable fasteners proximate said free edges thereof where said panels overlap.

18. A self-storing article of bedding according to claim 16 wherein said cover is formed of a plurality of sheets of fabric material sewn together around their outer edges.

19. A self-storing article of bedding according to claim 18 wherein said top surface of said cover is provided with surface ornamentation at said pocket area of said cover.

20. A self-storing article of bedding according to claim 16 wherein said panels are formed of a water repellent material and further comprising a water repellant protection sheet secured to said top surface over said pocket area of said cover.

* * * * *